US006993873B2

(12) United States Patent
Biebuyck et al.

(10) Patent No.: US 6,993,873 B2
(45) Date of Patent: Feb. 7, 2006

(54) BUILDING CURTAIN WALL MULLION AND SILL ASSEMBLY

(75) Inventors: Lawrence F. Biebuyck, Garland, TX (US); James P. Clark, Terrell, TX (US); Stanley J. Mayhew, Terrell, TX (US)

(73) Assignee: Butler Manufacturing Company, Kansas City, MO (US)

( * ) Notice: Subject to any disclaimer, the term of this patent is extended or adjusted under 35 U.S.C. 154(b) by 212 days.

(21) Appl. No.: 10/388,007

(22) Filed: Mar. 12, 2003

(65) Prior Publication Data

US 2004/0074174 A1 Apr. 22, 2004

Related U.S. Application Data

(60) Provisional application No. 60/364,880, filed on Mar. 13, 2002.

(51) Int. Cl.

| | |
|---|---|
| ***E04B 2/96*** | (2006.01) |
| ***E04B 1/16*** | (2006.01) |
| ***E04B 3/54*** | (2006.01) |

(52) U.S. Cl. ..... 52/235; 52/741.4; 52/733.4; 52/730.5

(58) Field of Classification Search ..... 52/235, 52/741.4, 733.4, 730.5, 301, 223.9, 702, 52/698, 717.01, 125.4, 712, 285.3, 796.12; 248/251, 261, 266

See application file for complete search history.

(56) References Cited

U.S. PATENT DOCUMENTS

| | | | | | |
|---|---|---|---|---|---|
| 925,677 | A | * | 6/1909 | Belcher | 52/656.1 |
| 1,799,160 | A | * | 4/1931 | Franks | 52/149 |
| 2,853,750 | A | * | 9/1958 | Davies et al. | 52/718.02 |
| 2,963,126 | A | * | 12/1960 | Cudini | 52/302.6 |
| 3,353,301 | A | * | 11/1967 | Heilweil et al. | 49/489.1 |

(Continued)

FOREIGN PATENT DOCUMENTS

GB 2142357 A * 1/1985

OTHER PUBLICATIONS

Kawneer Architectural Products/Amax Aluminum: Aluminum Curtain Wall and Window Manual, "Seamless Mullion 300T•400T•400", Jan. 1978 (16 pages).

*Primary Examiner*—Robert Canfield
(74) *Attorney, Agent, or Firm*—Jenkens & Gilchrist, P.C.

(57) ABSTRACT

Disclosed is a curtain wall assembly used for building exteriors. The curtain wall system includes a first vertical mullion operable to attach to a first sill member and a second vertical mullion operable to interlock with the first vertical mullion. A mullion cap may be attached to a bottom surface of at least one of the vertical mullions. The mullion cap includes a substantially planar bottom plate having an upper surface, a lower surface, a front edge, and a back edge. The mullion cap further includes an attachment face located on the upper surface of the substantially planar bottom plate. The attachment face is operable to attach to the vertical mullion.

9 Claims, 8 Drawing Sheets

U.S. PATENT DOCUMENTS 3,417,537 A * 12/1968 Wilson ..... 52/731.5
3,466,826 A * 9/1969 Gallagher et al. ..... 52/395
3,601,946 A * 8/1971 Rothemund ..... 52/730.5
3,932,974 A * 1/1976 Wright ..... 52/235
4,386,486 A * 6/1983 Holt et al. ..... 52/125.5
4,619,092 A 10/1986 Kaminaga ..... 52/235
4,724,637 A * 2/1988 Evans ..... 52/209
4,799,344 A 1/1989 Francis ..... 52/235
4,803,820 A 2/1989 Metrick ..... 52/397
4,817,351 A 4/1989 Michlovic ..... 52/235
4,873,806 A 10/1989 Jeschke ..... 52/235
4,899,508 A 2/1990 Biebuyck ..... 52/235
4,981,276 A * 1/1991 Agor et al. ..... 248/222.14
4,984,400 A 1/1991 Bockmiller ..... 52/241
4,996,809 A 3/1991 Beard ..... 52/200
4,999,961 A * 3/1991 McNary ..... 52/287.1
5,065,557 A 11/1991 Laplante et al. ..... 52/235
5,077,947 A 1/1992 Takeda ..... 52/235
5,095,672 A * 3/1992 Tanikawa ..... 52/215
5,105,593 A * 4/1992 Kaminaga et al. ..... 52/235
5,185,979 A 2/1993 Azzimonti ..... 52/235
5,252,154 A 10/1993 Hoffman ..... 156/71
5,253,459 A * 10/1993 Parinas et al. ..... 52/235
5,333,428 A 8/1994 Taylor et al. ..... 52/308
5,354,410 A 10/1994 Cohen et al. ..... 156/552
5,546,713 A 8/1996 Voegele, Jr. et al. ..... 52/202
5,560,149 A 10/1996 Lafevre ..... 49/501
5,592,795 A 1/1997 Rinehart et al. ..... 52/235
5,746,032 A 5/1998 Koike et al. ..... 52/204.1
5,839,236 A * 11/1998 Frey ..... 52/235
5,937,597 A * 8/1999 Sono et al. ..... 52/204.1
6,158,182 A 12/2000 Biebuyck ..... 52/235

* cited by examiner

BUILDING CURTAIN WALL MULLION AND SILL ASSEMBLY

RELATED APPLICATIONS

This patent application claims the benefit of priority from co-pending U.S. Provisional Patent Application Ser. No. 60/364,880 filed on Mar. 13, 2002.

BACKGROUND OF THE INVENTION

1. Field of the Invention

The present invention relates to curtain walls used for building exteriors and, more particularly, but not by way of limitation, to the construction and assembly of sill and mullion sections of such curtain walls along with the curtain wall panels associated therewith.

2. Description of the Related Art

Curtain walls are typically constructed of extruded aluminum frame support members having generally U-shaped channels (although other shapes may apply) for supporting a plurality of panel members that serve as the exterior of a building. Such panel members are most often panes of glass, and often double pane glass sections, but other paneled building materials such as aluminum, granite, slate, or concrete are also utilized. Such panel members are often of identical size and shape. However, near doors, opening windows, or other access points into the building, panel members of different sizes and shapes may be utilized.

More specifically, such curtain walls generally include a horizontal sill member having at least one portion forming a channel at the bottom of a wall section, a horizontal head member having a downwardly facing channel at the top of a wall section, and a plurality of vertical mullions running between the sill and head members. Panel members are supported by the channels of the sill member and the head member, and the vertical joints between adjacent panel members are formed at the mullions. In some designs, the mullions are disposed interiorly of the sill member, the head member, and the panel members so that only the joint between adjacent panel members, and not the mullions themselves, are visible from the exterior of the building. The designs do, however, vary, depending upon the desired aesthetics of the curtain wall construction.

In another curtain wall construction, multiple panel members are typically arranged side-by-side and are secured and sealed between a sill member and a head member, with their vertical joints overlapping at a mullion. This vertical joint must then be sealed from both the interior and exterior of the building using both resilient gaskets, sealant tapes, sealant, and/or structural silicone, as described for reference purposes below.

An existing solution is set forth and shown in U.S. Pat. No. 6,158,182 and assigned to the assignee of the present invention. Referring now to FIG. 1, a schematic, cross-sectional view of a sill member 10 of an exemplary curtain wall is shown. The sill member 10 secures a curtain wall to a structural support surface such as a concrete slab 12. The concrete slab 12 may be at ground level or comprising a floor surface of a high rise building. Although not shown in FIG. 1, a head member similar to the sill member 10 secures the curtain wall to a concrete slab between floors of a building or other building structures, and a plurality of mullions span between the sill member 10 and the head member. The sill member 10 is typically formed as an integral aluminum extrusion. The sill member 10 also generally includes a channel section 14, an anchoring section 16 disposed interiorly of a channel section 14, and a cover 18.

Still referring to FIG. 1, the channel section 14 and the cover 18 cooperate to secure the panel member 20 to the sill member 10. More specifically, the channel section 14 includes a base 14*a* and two legs 14*b* and 14*c* that form a upwardly facing U-shaped channel. A support member 22 rests on the top surface of the base 14*a*. The exterior leg 14*b* has a groove 24 proximate the upper end of its interior surface facing the panel member 20, and the interior leg 14*c* has a support surface 26 proximate the upper end of its interior surface. The cover 18 has a downward projecting leg 28 that engages a groove 30 on the exterior surface of the interior leg 14*c*. The cover 18 also has two tongues 32, 49, one proximate to each end of the cover 18. The panel member 20 is placed within the channel section 14 on an upper surface of a setting block 34. An exterior and interior gasket 36, 38 are located at the upper end of the exterior and interior legs 14*b*, 14*c*. The gaskets 36, 38 operate to hold the panel member 20 in the channel section 14. The setting block 34 is disposed on the top surface of the support member 22. The exterior gasket 36 has a tongue 36*a* that engages the groove 24 of the exterior leg 14*b*. The exterior gasket 36 is typically pre-installed in groove 24 of the exterior leg 14*b* during the manufacture of the sill member 10. The interior gasket 38 has a groove 38*a* that engages the tongue 32 of the cover 18 and the support surface 26 of the interior leg 14*c*. The channel section 14 further includes a plurality of support legs 40 below base 14*a*.

The anchoring section 16 includes a base 16*a*, an interior leg 16*b*, and a plurality of support legs 42 below the base 16*a*. The base 16*a* has a plurality of holes 44 spaced along its length for receiving fasteners 46 to secure the sill member 10 to the structural support surface 12. The interior leg 16*b* has a groove 48 for receiving the tongue 49 of the cover 18. The cover 18 stabilizes the interior gasket 38 that presses against the panel member 20 and also conceals the base 16*a* of the anchoring section 16 so that the fasteners 46 are not visible. A drawback of this example is that the panel member 20 cannot be installed until the cover 18 is placed over the fasteners, due to the fact that the cover 18 is needed to hold the interior gasket in place against the panel member 20. Therefore, the entire structure must be inspected before the panel member 20 is installed as discussed in more detail below.

The following technique is typically used to install the panel member 20 of such a curtain wall. First, the sill member 10 is laid on a shim 56 in the proper position on the concrete slab 12 and is used as a template to drill holes into the concrete slab 12 for each fastener 46. One should note that the shim 56 does not run continuously along the length of the sill member 10. Instead, the shim 56 is used at low points of the concrete slab 12 to level the sill member 10, if necessary. The sill member 10 is removed from the shim 56, and a hole 50 with a larger diameter is drilled in the place of each of the holes drilled using the sill member 10. A structural insert 52 is secured within each of the holes 50 via epoxy or other conventional means. Each insert 52 has an internally threaded hole 54 for receiving fasteners 46. The sill member 10 is repositioned on the shim 56 and secured to the concrete slab 12 using fasteners 46. A sealant 58 is disposed continuously on the concrete slab 12 along both the exterior and interior sides of the shim 56. A head member similar to the sill member 10 is secured to part of the building structure using the above-described techniques. Vertical mullions are secured between the sill member 10 and the head member at appropriate intervals along the curtain wall. The vertical mullions are attached at each side to sill members 10. The support member 22 is disposed on the base 14*a* of the sill member 10, and the setting block 34 is disposed on the support member 20. The panel member 20 is then installed from the exterior of the building, typically first being tilted into the channel section of the head member, and then being dropped into the channel section 14 of the sill member 10. The cover 18 is installed in the sill member 10, and a glazing stop is installed in the head member of the curtain wall. The interior gasket 38 is disposed on the tongue 32 of the cover 18 of the sill member 10, and a similar gasket is disposed on the tongue of the glazing stop of the head member.

While such curtain walls, and other conventional curtain walls, have proved to be reliable commercial building systems, they suffer from several drawbacks. For example, installing the panel members at the building site also requires inspections during the process. These inspections must be performed by building code enforcement personnel, whose schedule may or may not be compatible with time schedules for the contractor erecting such curtain walls.

Another solution is set forth and shown in U.S. patent application Ser. No. 10/099,070, now issued as U.S. Pat. No. 6,715,248, assigned to the assignee of the present invention, and incorporated herein by reference. Referring now to FIG. 2, a side cross-sectional view a sill assembly 100 of the '070 patent application is shown. By first installing a sill flashing 112 directly upon a support surface 155 such as a concrete slab, the remaining portions of the curtain wall may be assembled at the factory prior to delivery to the field for installation. An outside cap 108, an interior cover 110, and a sill member 106 are adapted for resting upon and mounting to the sill flashing 112.

The curtain wall as set forth in the '070 patent application is assembled by first temporarily fastening, with a fastener 153, the sill flashing 112 to the support surface 155 of a building at the job site. The sill member 106 is mounted to two vertical mullions (not shown) at opposite ends of the sill member 106. An outside cap 108 is secured to the sill member 106 and provides a groove for attaching an exterior gasket 151. The exterior gasket 151 presses against the exterior of the panel member 150 to secure the panel member 150 set on the top surface of a setting block 200 placed in a channel of the sill member 106. The sill member 106, outside cap 108, panel member 150, and setting block 200 may be preassembled at a factory prior to being shipped to the job site. However, the sill flashing 112 must be temporarily secured at the job site prior to fastening the sill member 106 and other components permanently to the support surface 155. After the sill flashing 112 has been temporarily secured to the support surface 150 and the sill member 106, outside cap 108, panel member 150, exterior gasket 151, and setting block 200 have been assembled at the factory and shipped to the job site, then the sill member 106 is permanently secured to the sill flashing 112 and the support surface 155 with at least one fastener 152. Building code enforcement personnel then inspect the securement of the sill assembly 100. Once approved, then the interior cover 110 is secured to the sill flashing 112 and the sill member 106.

The '070 patent application allows for some pre-assembly to occur at the factory, however, the sill assembly must to be split into two pieces, namely the sill member 106 and the sill flashing 112, in order to allow the pre-assembly of the sill member 106 with other components.

For this reason, it would be greatly advantageous to provide a curtain wall system construction that maximizes the ability for pre-assembly without sacrificing the structural integrity of the overall curtain wall system.

SUMMARY OF THE INVENTION

The present invention relates to curtain walls used for building exteriors and the assembly of a building curtain wall with a sill and mullion assembly permitting the substantially flush mounted panel members therewith. More particularly, one aspect of the present invention relates to a curtain wall system including a first vertical mullion operable to attach to a first sill member and a second vertical mullion operable to interlock with the first vertical mullion. The present invention also relates to a mullion cap for attaching to a bottom surface of a vertical mullion. The mullion cap includes a substantially planar bottom plate having an upper surface, a lower surface, a front edge, and a back edge. The mullion cap further includes an attachment face located on the upper surface of the substantially planar bottom plate. The attachment face is operable to attach to the vertical mullion.

In another aspect, the present invention includes a curtain wall system comprising a first vertical mullion operable to attach to a first sill member, and a second vertical mullion operable to interlock with the first vertical mullion. The first vertical mullion may also include a protrusion and the second vertical mullion may include a groove for interlocking with the protrusion. In one aspect, the first sill member attaches to the first vertical mullion via at least one screw spline and screw. The second vertical mullion may also be further operable to attach to a second sill member, while the first sill member may be formed as a single extrusion. The curtain wall system may also include a mullion cap for attaching to a bottom surface of at least one of the first and second vertical mullions. In one aspect, the mullion cap attaches to the first vertical mullion. The vertical mullions may also include a securement clip for attaching the vertical mullions to one another. The securement clip may be fastened to an interior surface of a second vertical mullion. The securement clip includes an extension that abuts a securement face located on an interior surface of the first vertical mullion.

BRIEF DESCRIPTION OF THE DRAWINGS

For a more complete understanding of the present invention, and for further objects and advantages thereof, reference is made to the following description taken in conjunction with the accompanying drawings in which.

DETAILED DESCRIPTION OF THE PREFERRED EMBODIMENT

Figure 1:
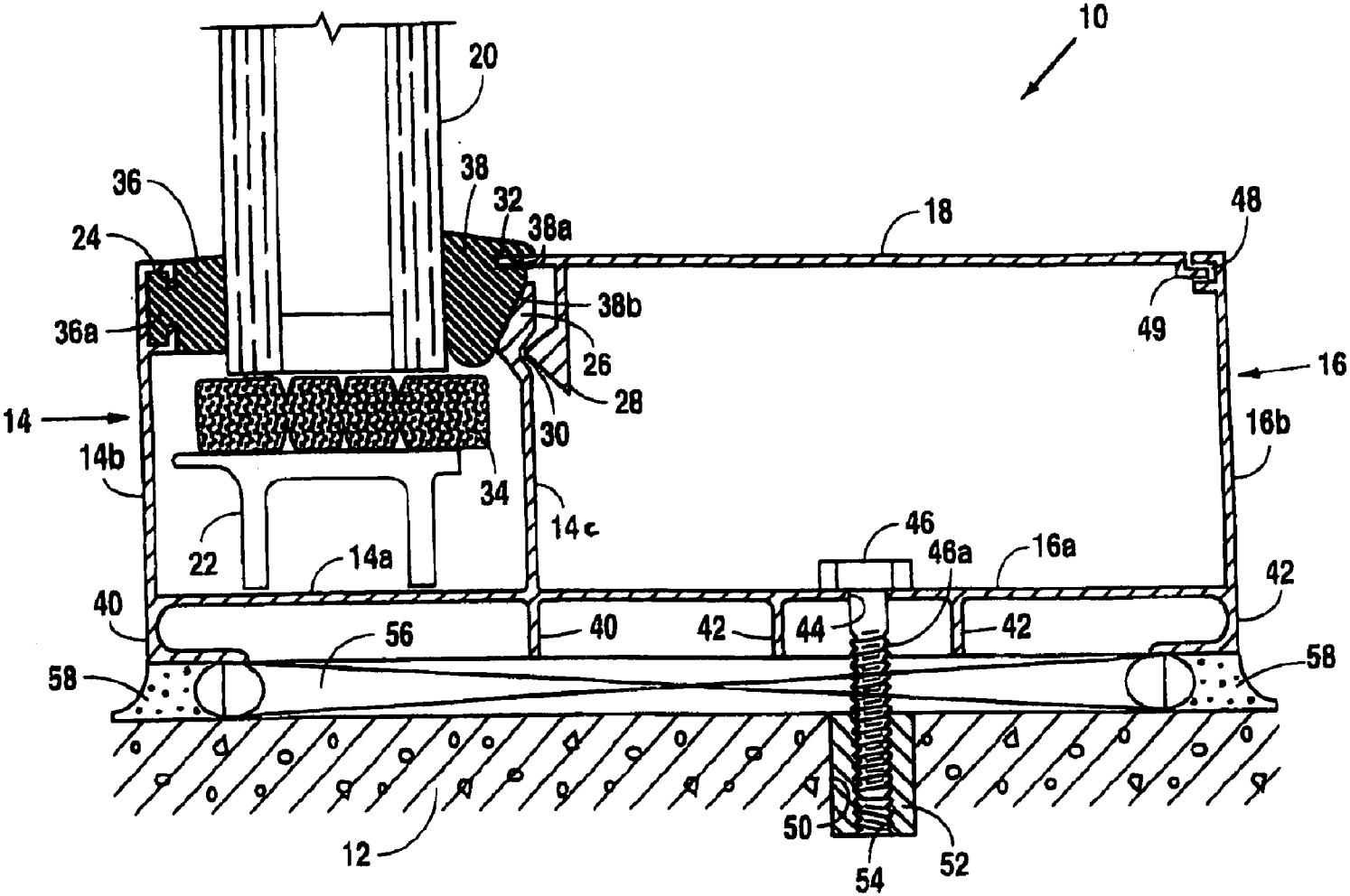
FIG. 1 (PRIOR ART)
FIG. 1 (Prior Art) illustrates a side cross-sectional schematic view of a sill member of a conventional curtain wall.
Figure 2:
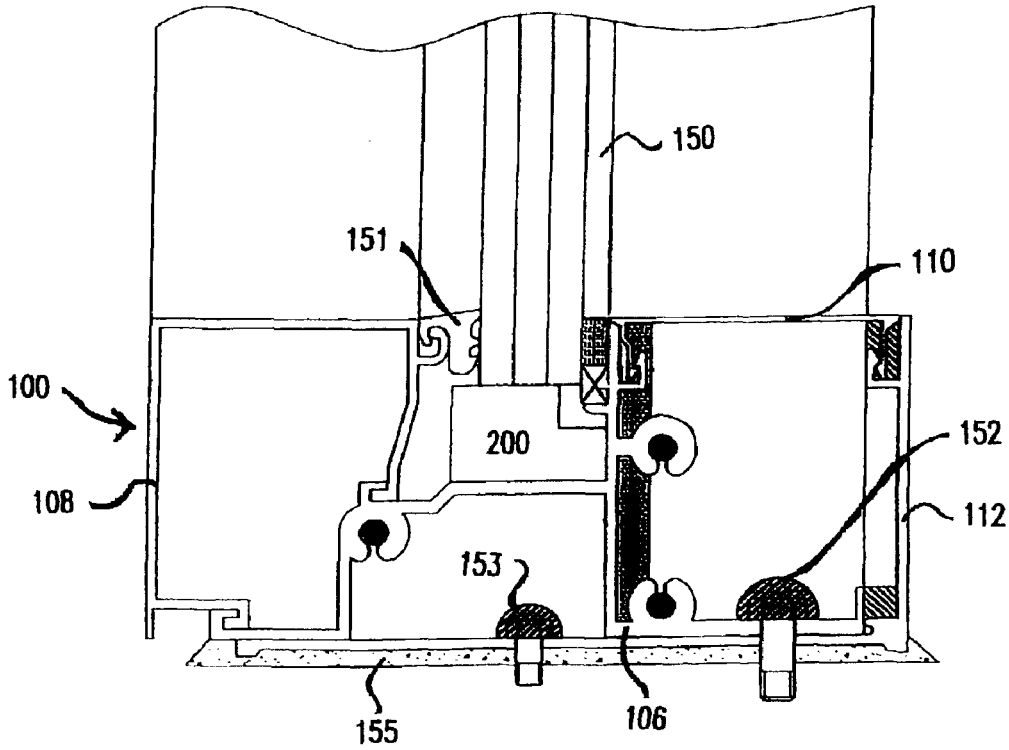
FIG. 2 illustrates a side cross-sectional view of a sill assembly of a curtain wall system.
Figure 3:
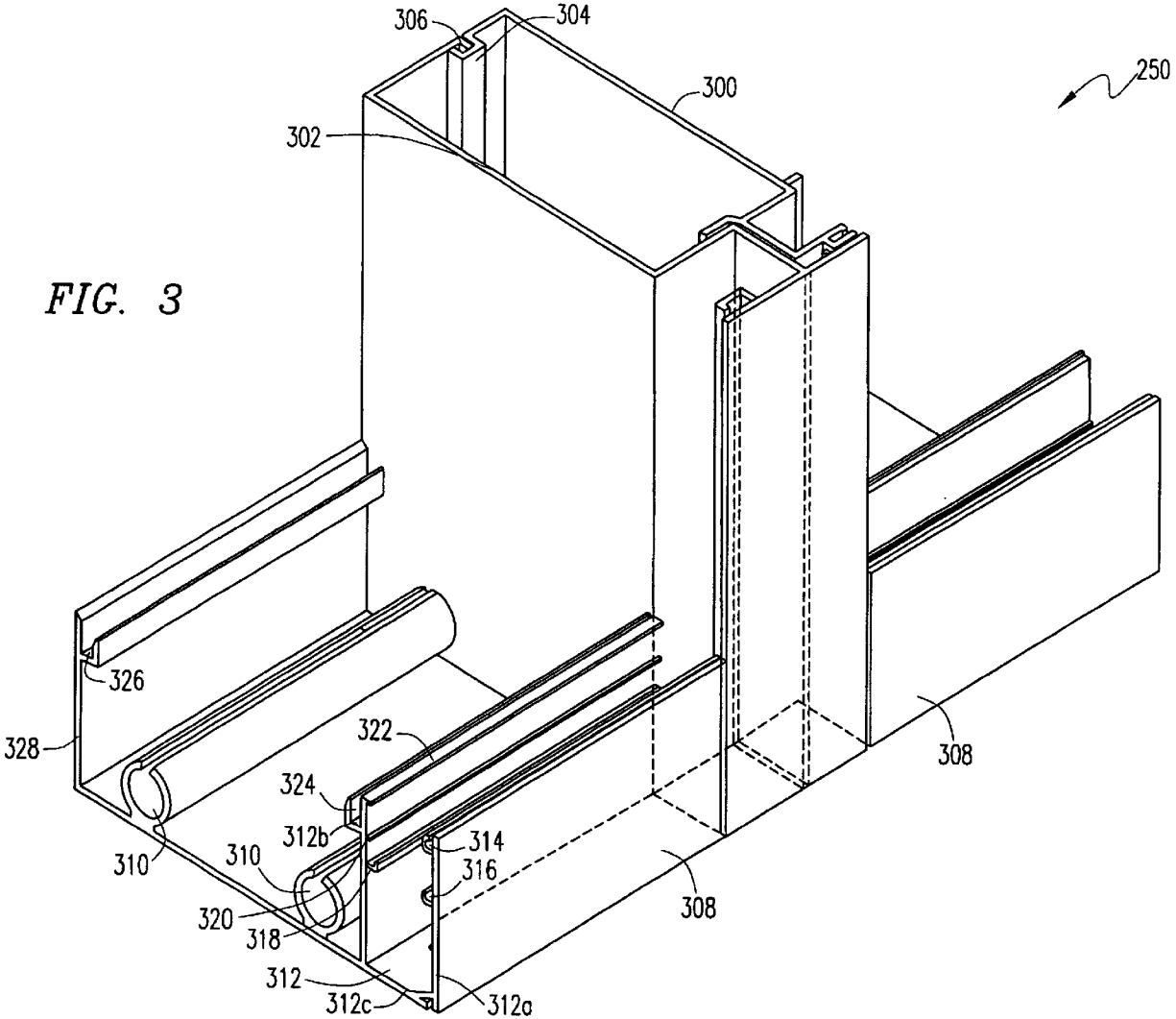
FIG. 3 illustrates a perspective view of a sill and mullion assembly according to an embodiment of the present invention.

In the present embodiment, as shown in FIG. 3, a curtain wall assembly 250 of a preferred embodiment of the present invention is illustrated. Vertical mullions 300, 302 are extruded in a shape permitting direct interengagement one with the other. One of the vertical mullions 300 is formed to provide a groove 304 on its rearward face for receiving a protrusion 306 of another of the vertical mullions 302. The groove 304 and protrusion 306 are arranged so that the vertical mullions 300, 302 are angled with respect to each other and then rotated until the rearward faces of both vertical mullions 300, 302 are aligned in a planar fashion as described in more detail in FIGS. 7 and 8. Although the preferred embodiment of the present invention describes the interlocking mechanism of the vertical mullions as a groove 304 and protrusion 306, any means of interlocking the two vertical mullions 300, 302 together may be used. For example, a male and female snap arrangement may be employed, as well as two protrusions from the rearward faces of the vertical mullions 300, 302 which may be secured together with additional fasteners. The interlocking vertical mullions 300, 302 permit a restricted amount of movement to allow for thermal expansion and contraction while preventing failure under extreme stresses that may be exhibited by a hurricane or other natural disasters.

Sill members 308 are constructed as a single extrusion for direct engagement with the vertical mullions 300, 302 via screw splines 310. The sill members 308 are further constructed to provide a channel 312 for receiving a panel member (not shown) such as glass, granite, or other building material. The sill members 308 are fastened to the vertical mullions 300, 302 which are then interlocked. The sill members 308 also provide various other grooves within the channel 312 for receiving components used to stabilize or secure the panel member. In the preferred embodiment, the interior surface of a forward leg 312*a* of the channel 312 includes two grooves 314, 316 while the interior surface of an intermediate leg 312*b* includes a groove 318, a support leg 320, and an upper protrusion 322. These grooves 314, 316, 318, the support leg 320, and the upper protrusion 322 may be oriented in a variety of ways to aid in the securement of various components placed in the channel 312. In an alternate embodiment, the grooves 314, 316, 318, support leg 320, and upper protrusion 322 are eliminated and the components may be placed directly on the upper surface of a base 312*c* of the channel 312. The face opposite the groove 318 and support leg 320 of the intermediate leg 312*b* includes a groove 324 in addition to a groove 326 disposed on the interior surface of a rearward leg 328. In the preferred embodiment, the screw splines 310 are oriented between the intermediate and rearward legs 312*b* and 328.

Figure 5:
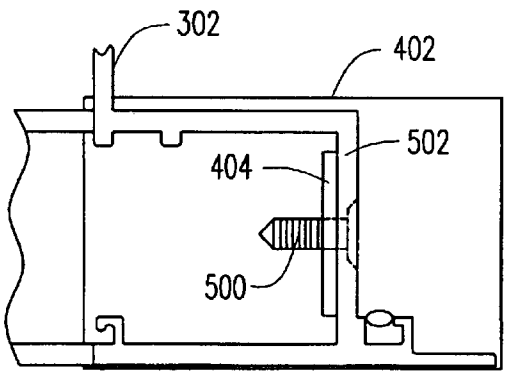
FIG. 5 illustrates an enlarged top view of the vertical mullion and mullion cap as shown in FIG. 4.
Figure 4:
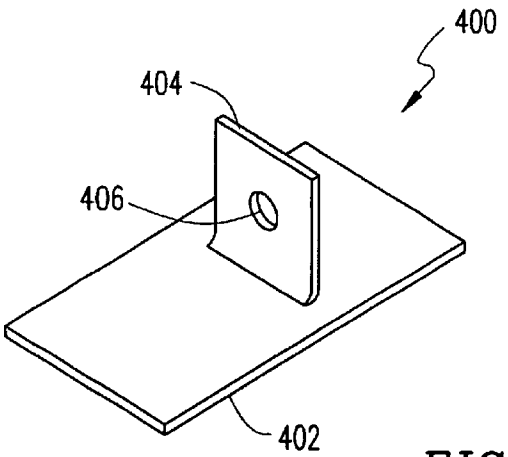
FIG. 4 illustrates an enlarged perspective view of a mullion cap as shown in accordance with an alternate embodiment of the present invention.
Figure 6:
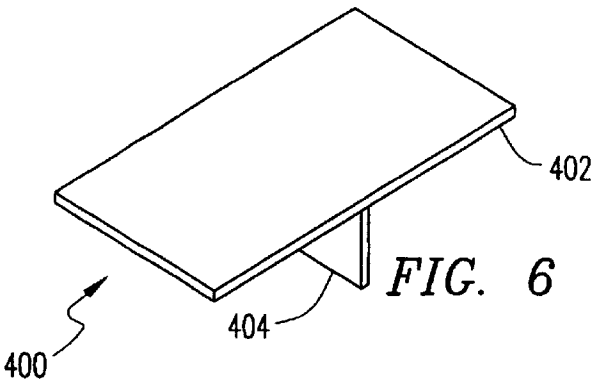
FIG. 6 illustrates a bottom view of the mullion cap as shown in FIG. 4.

Referring now to FIGS. 4–6, a mullion cap 400 may be used with the curtain wall assembly 250 of the present invention. The mullion cap 400 may also be eliminated in an embodiment of the present invention. The mullion cap 400 includes a bottom plate 402 that is substantially planar and substantially rectangular in shape, however, other orientations may be used depending on the configuration of the vertical mullions 300, 302 and the sill members 308. On an upper surface of the bottom plate 402, an attachment face 404 is located approximately near the center of the bottom plate 402. In the preferred embodiment, sides of the attachment face 404 do not extend to the outside edges of the bottom plate 402. In alternate embodiments, the attachment face 404 may be located at a position other that near the center of the bottom plate 402 and may also have sides that extend to or beyond the edges of the bottom plate 402. Also in the preferred embodiment, the attachment face 404 includes an aperture 406 for securement to at least one of the vertical mullions 300, 302. A lower surface of the bottom plate 402 is substantially planar as illustrated in FIG. 6, although other orientations are possible.

As shown in the top view of FIG. 5, a fastener 500 is utilized to secure the attachment face 404 of the mullion cap 400 to a vertical face 502 of the vertical mullion 302. The attachment face 404 may also be oriented in another direction to facilitate securement to another face of the vertical mullion 302. As shown, the bottom plate 402 abuts the lower surface of the vertical mullion 302 and extends on both sides of the vertical face 502. The bottom plate 402 may also be fabricated to be flush with the vertical face 502 instead of extending past the vertical face 502.

Figure 7:
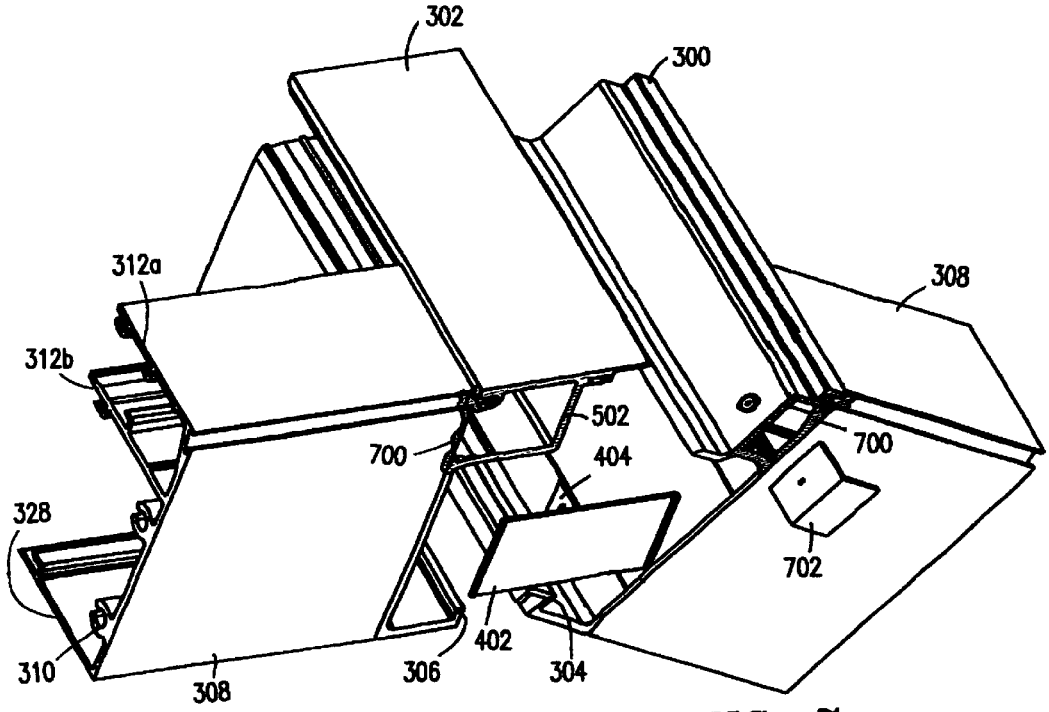
FIG. 7 illustrates a bottom exploded view of a sill and mullion assembly including the mullion cap of FIG. 4 according to an alternate embodiment of the present invention.
Figure 8:
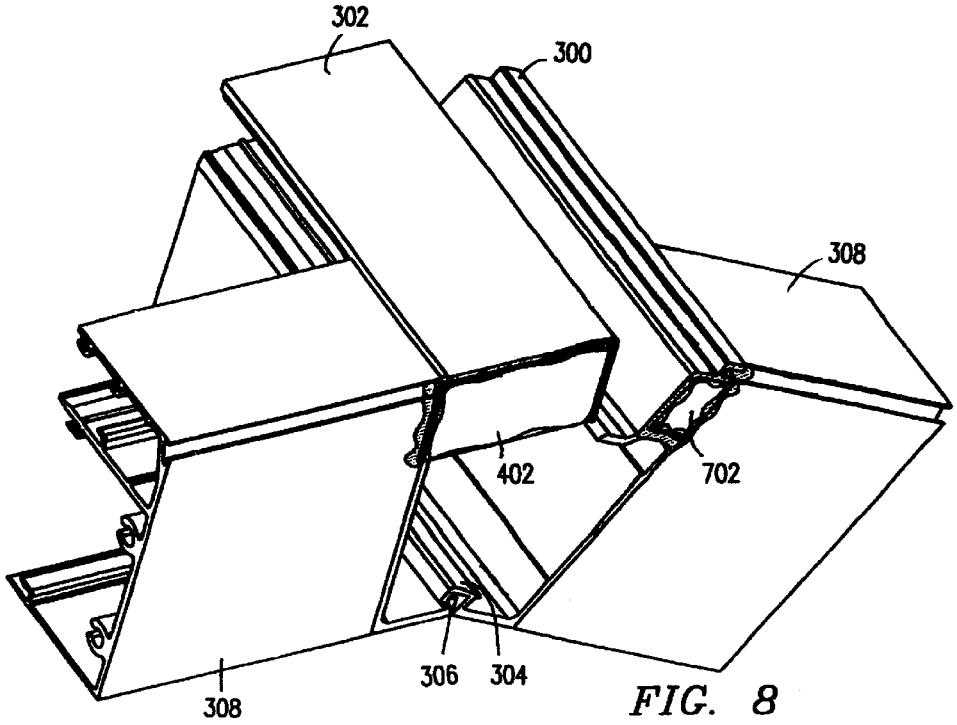
FIG. 8 illustrates a bottom perspective view of the sill and mullion assembly including the mullion cap of FIG. 5.

FIGS. 7 and 8 illustrate the process of interlocking the vertical mullions 300, 302 together, as well as the securement of the mullion cap 400 to the bottom surface of the vertical mullions 300, 302. The vertical mullions 300, 302 are angled with respect to each other and sealant 700 is placed on bottom edges of the vertical mullions 300, 302, as well as an upper surface of the mullion cap 400. The mullion cap 400 is secured to the bottom surface of the vertical mullions 300,302. An end dam 702 may also be utilized in the preferred embodiment and attached to the vertical mullion 300 that is not secured to the mullion cap 400. The end dam 702 is secured to a vertical face of the vertical mullion 300 in a similar fashion to that of the mullion cap 400. The sealant 700 placed on the upper surface of the mullion cap 400 marries the end dam 702 to the mullion cap 400, thereby providing a water tight seal. As shown in FIG. 8, the groove 304 may be placed over the protrusion 306 and rotated into position. In an alternate embodiment, the vertical mullions 300, 302 may be rotated into position and then the sealant 700 may be applied. Then the mullion cap 400 may be secured to the bottom surface of the vertical mullions 300, 302.

Figure 9A:
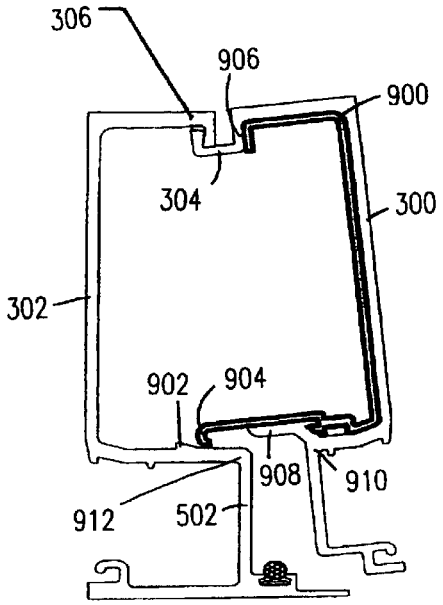
FIG. 9A illustrates a top view of a securement clip of the mullion assembly of an alternate embodiment of the present invention.
Figure 9B:
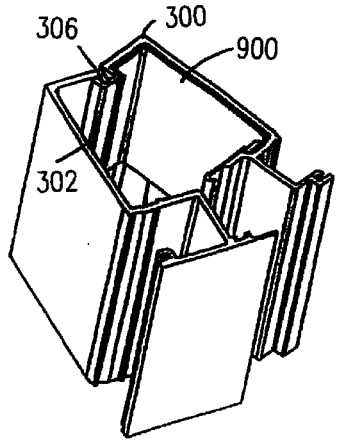
FIG. 9B illustrates a perspective view of a securement clip of the mullion assembly of FIG. 9A.

Now referring to FIGS. 9A and 9B, a securement clip 900 according to an alternate embodiment of the present invention is described. To further enhance the structural integrity of the interlocking vertical mullions 300, 302 during negative pressure loading, a securement clip 900 may be added to an internal face of the vertical mullion 300 including the groove 304. In a first embodiment of the securement clip 900, the securement clip 900 is formed of a single aluminum extrusion and is fashioned with an extension 904 at one end of the securement clip 900. Although in the preferred embodiment a single aluminum extrusion is utilized, other configurations and material may be used to form the securement clip 900. Other configurations may include multiple pieces and may span only a portion of the interior face. The securement clip may also be integrally formed with the vertical mullion 300. The securement clip 900 abuts the internal face of the vertical mullion 300 from a side 906 of the groove 304 to a leg 908 oriented at or near a corner 910 of the vertical mullion 300. The leg 908 abuts at least a portion of the extension 904. The extension 904 includes a curved end portion for fastening against a securement face 902 of the opposite vertical mullion 302 with the protrusion 306. The securement face 902 protrudes from an interior surface at or near a corner 912 of the vertical mullion 302. The extension 904 of the securement clip 900 is operable to contact the securement face 902 as shown in FIGS. 10A and 10B.

Figure 10B:
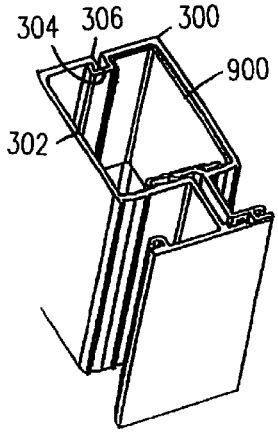
FIG. 10B illustrates a perspective view of the engaged securement clip of the mullion assembly of FIG. 10A.
Figure 10A:
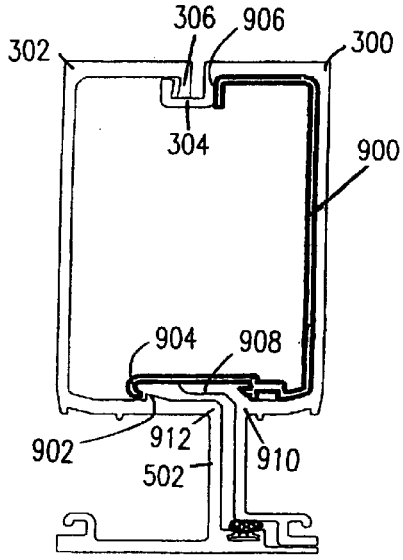
FIG. 10A illustrates a top view of the engaged securement clip of the mullion assembly of FIG. 9A.

As illustrated in FIGS. 10A and 10B, the curved end portion of the extension 904 abuts the securement face 902 to further secure the vertical mullions 300, 302. When the vertical mullions 300, 302 are interlocked, the respective corners 910, 912 are oriented near each other to facilitate engagement between the extension 904 and the securement face 902. As shown, the leg 908 is oriented to protrude rearward of the corners 910, 912 of the vertical mullions 300, 302 and supports the extension 904 of the securement clip 900. When the securement clip 900 is engaged, the leg 908 may rest on the interior surface of the vertical mullion 302 near the securement face 902.

Figure 11:
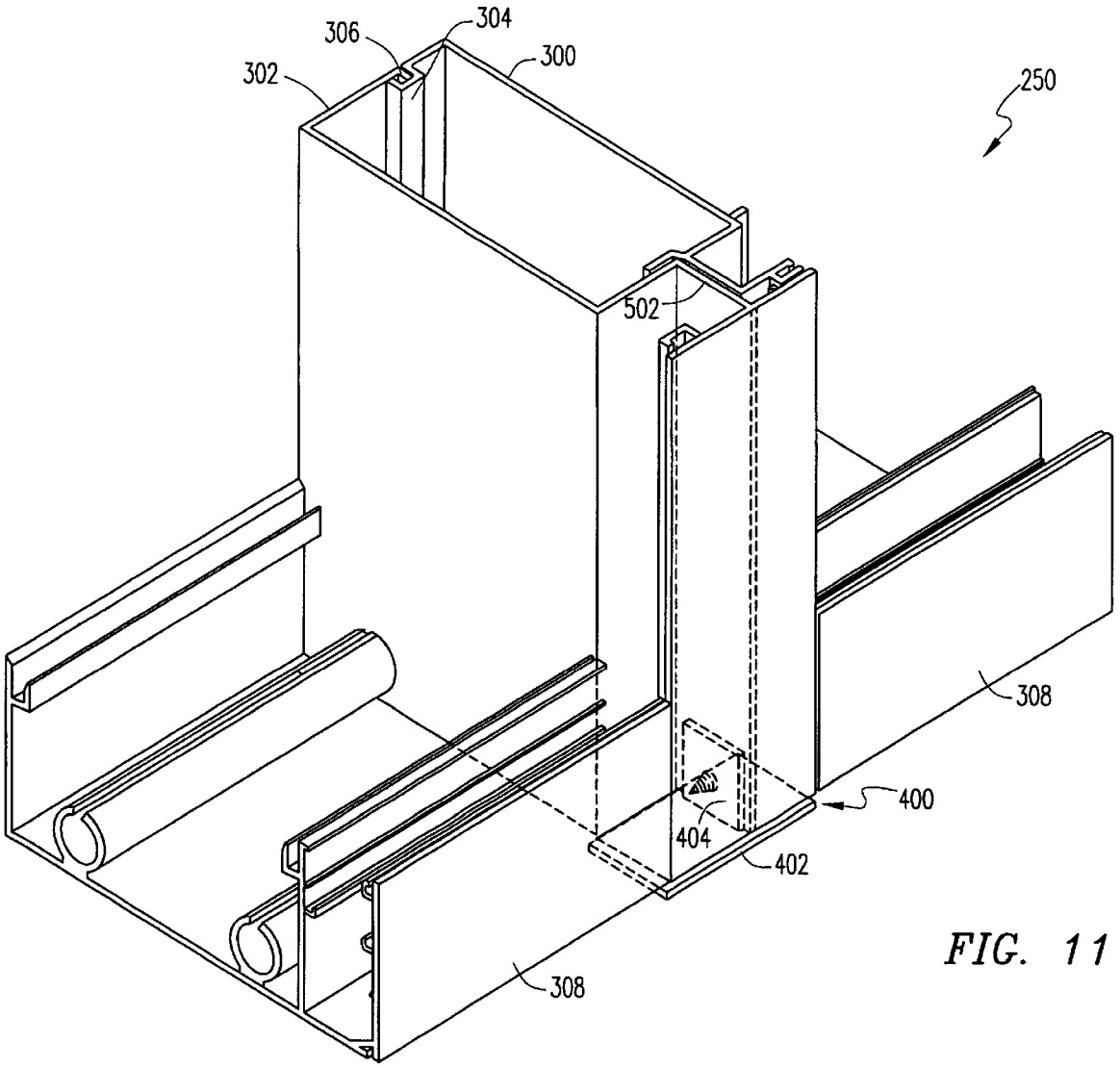
FIG. 11 illustrates a perspective view of the sill and mullion assembly according to an alternate embodiment of the present invention.

FIG. 11 illustrates the curtain wall assembly 250 once the vertical mullions 300, 302 have been rotated into place and the mullion cap 400 has been secured to the vertical face 502 of the vertical mullion 302 and a bottom surface of the end dam 702. Once rotated into position, the rear faces of both vertical mullions 300, 302 are substantially planar. Depending on the interlocking mechanism utilized, one of the rear faces may be slightly inset with respect to the other rear face. As shown and discussed with reference to FIG. 5, in the preferred embodiment, the bottom plate 402 of the mullion cap 400 substantially covers the lower surface of the curtain wall assembly 250 from the edge of the sill member 308 attached to one vertical mullion 302 to the edge of a second sill member 308 attached to the other vertical mullion 300 that is interlocked with the first vertical mullion 302. The mullion cap 400, as installed, creates a water tight seal for the vertical mullions 300, 302. The interlocking vertical mullions 300, 302 also provide addition structural support and do not pull apart when loaded with extreme stresses such as those experienced during natural disasters.

Figure 12:
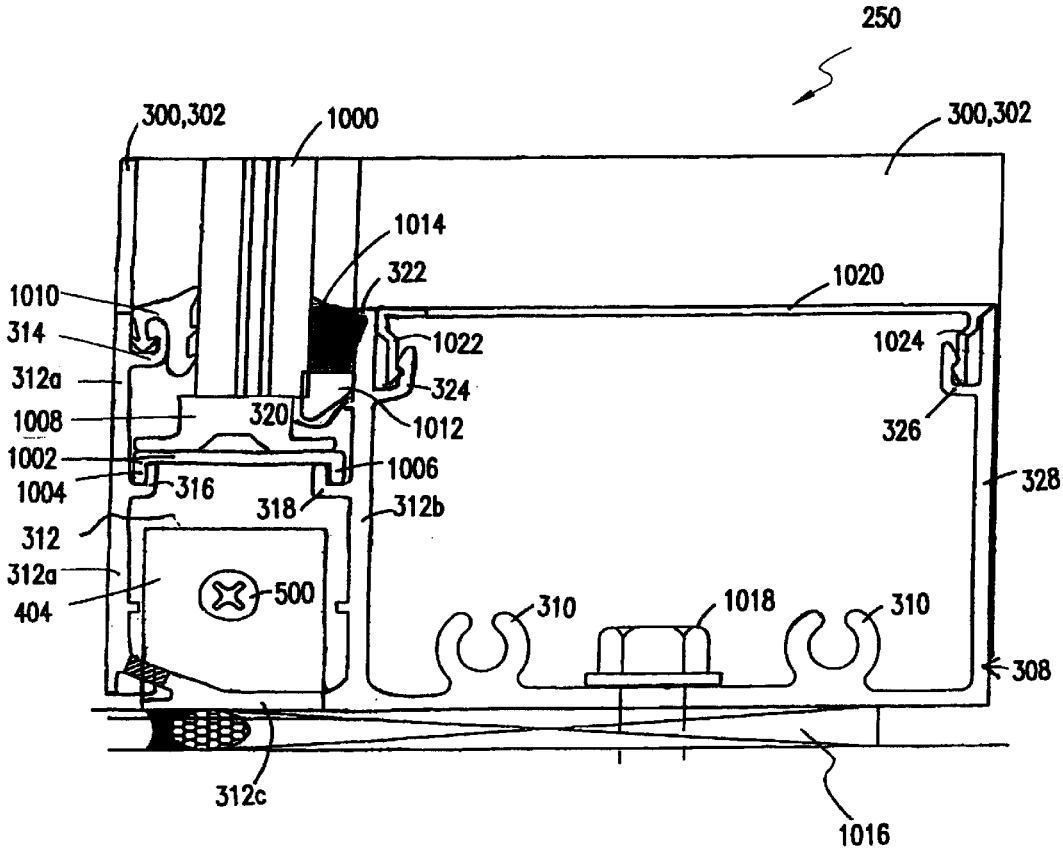
FIG. 12 illustrates a side cross-sectional view of the sill and mullion assembly including the mullion cap of FIG. 5.

Referring now to FIG. 12, a curtain wall assembly 250 including a panel member 1000 secured in the channel 312 of the sill member 308 is illustrated. A setting chair 1002 may be fashioned with two legs 1004, 1006 operable to sit in the grooves 316, 318 of the forward leg 312*a* and the intermediate leg 312*b*, respectively. A setting block 1008 rests on an upper surface of the setting chair 1002. The panel member 1000 has a lower surface that rests on the upper surface of the setting block 1008. As noted above, the setting block 1008 may also rest on an upper surface of the base 312*c* of the channel 312. An exterior gasket 1010 attaches to the forward leg 312*a* via the groove 314. The exterior gasket 1010 aids in the stabilization and securement of the panel member 1000 in the channel 312. On the interior side of the panel member 1000, a plug 1012 is supported by the support leg 320 of the intermediate leg 312*b*. On the upper face of the plug 1012, structural silicone 1014 is utilized to create a water tight and structural seal between the panel member 1000 and the intermediate leg 312*b*. In an alternate embodiment, in place of the plug 1012 and the structural silicone 1014, a gasket similar to the exterior gasket 1010 may be utilized. The panel member 1000 is stabilized and secured via the exterior gasket 1010, the setting chair 1002, the setting block 1008, the plug 1012, and the structural silicone 1014. The assembly of the panel member 1000 within the channel 312 may take place at the factory or other alternate site.

The curtain wall assembly 250 may be assembled at the factory and then shipped to the job site. The assembly required at the job site is the attachment of the sill member 308 to a support structure 1016 of the building via at least one fastener 1018. The fastener 1018 secures the bottom surface of the sill member 308 to the support structure 1016. Once the sill member 308 is secured, an assembly cover 1020 is placed over the exposed portion of the sill member 308. Preferably, the assembly cover 1020 includes two legs 1022, 1024, one disposed at each end of the assembly cover 1020. The forward leg 1022 is operable to fit in the groove 324 located on the intermediate leg 312*b* and the rearward leg 1024 is operable to fit in the groove 326 located on the rearward leg 328. The assembly cover 1020 may also be fastened to the sill member 308 by other securement means such as fasteners or snaps. By allowing direct access to the fully assembled and secured curtain wall assembly 250, an inspector may easily view the securement of the sill member 308 to the support structure 1016. Once viewed, the assembly cover 1020 may be secured to the sill member.

It is thus believed that the operation and construction of the present invention will be apparent from the foregoing description. While the curtain wall assembly shown and described have been characterized as being preferred it will be obvious that various changes and modifications may be made therein without departing from the spirit and scope of the invention.

What is claimed is:

1. A curtain wall system comprising:

a first vertical mullion operable to attach to a first sill member, the first vertical mullion including a protrusion and a securement face;

a second vertical mullion operable to interlock with said first vertical mullion, the second vertical mullion including a groove for interlocking with the protrusion and a securement clip for attaching to the securement face wherein the securement clip is fastened to an interior surface of said second vertical mullion.

2. The curtain wall system of claim 1, wherein said first sill member attaches to said first vertical mullion via at least one screw spline and screw.

3. The curtain wall system of claim 1, wherein said second vertical mullion is further operable to attach to a second sill member.

4. The curtain wall system of claim 1, wherein said first sill member is formed as a single extrusion.

5. The curtain wall system of claim 1, further comprising a mullion cap for attaching to a bottom surface of at least one of the first and second vertical mullions.

6. A method of sealing a void between a vertical mullion and a sill member of a curtain wall system, said method comprising the steps of:

forming a mullion cap including a substantially planar bottom plate and an attachment face located on an upper surface of said substantially planar bottom plate; intersecting said vertical mullion and said sill member, said intersection forming a void therebetween, the step of intersecting including interlocking a first portion of said vertical mullion with a second portion of said vertical mullion, and attaching an end dam to a first portion of said vertical mullion; and attaching said mullion cap to said vertical mullion, thereby filling said void.

7. The method of claim 6, wherein said attaching said mullion cap step comprises the steps of:

attaching said mullion cap to a second portion of said vertical mullion; and marrying said mullion cap to said end dam.

8. The method of claim 6, wherein said marrying step comprises the step of placing sealant between said mullion cap and said end dam.

9. The method of claim 6, wherein said interlocking step comprises the steps of:

placing a securement clip on an internal face of said vertical mullion; and attaching said securement clip to a securement face of said vertical mullion.

* * * * *